United States Patent [19]

Kennedy, Jr. et al.

[11] 4,120,699

[45] Oct. 17, 1978

[54] METHOD FOR ACOUSTICAL CLEANING

[75] Inventors: Alvin B. Kennedy, Jr., P.O. Box 1271, Alvin, Tex. 77511; Lawrence E. Shirey, Alta Loma, Tex.; Harper Eugene Sharp, Houston, Tex.; Lawrence E. Trowbridge, Seabrook, Tex.; Robert L. Magee, Alvin, Tex.

[73] Assignee: Alvin B. Kennedy, Jr., Alvin, Tex.

[21] Appl. No.: 668,316

[22] Filed: Mar. 18, 1976

Related U.S. Application Data

[63] Continuation-in-part of Ser. No. 521,762, Nov. 7, 1974, abandoned.

[51] Int. Cl.[2] ..... B08B 3/12; B08B 17/02; F28G 7/00

[52] U.S. Cl. ..... 134/1; 165/1; 165/84; 165/95

[58] Field of Search ..... 134/1; 23/252 B; 259/DIG. 44; 68/35.5; 21/54 A, 102 A; 165/1, 84, 95

[56] References Cited

U.S. PATENT DOCUMENTS

| | | | |
|---|---|---|---|
| 2,650,872 | 9/1953 | Goldwasser | 68/35.5 |
| 3,295,596 | 1/1967 | Ostrofsky et al. | 165/84 |
| 3,371,233 | 2/1968 | Cook | 68/35.5 |
| 3,614,069 | 10/1971 | Murray | 259/DIG. 44 |

*Primary Examiner*—Morris O. Wolk
*Assistant Examiner*—Bradley Garris
*Attorney, Agent, or Firm*—Guy E. Matthews

[57] ABSTRACT

In one exemplary embodiment, the efficiency of an acoustic-energy-type cleaner for vessels, such as heat exchangers, is substantially increased by propagating through the fluid in the vessel, a plurality of opposing acoustic wave trains, and continuously varying at least the frequency or phase relationship of said opposing wave trains for causing constructive interference between said opposing acoustic waves to create a series of augmented acoustic waves that are spatially displaced in relation to each other and successive in time interval for sweeping over the surfaces of the body to be cleaned.

11 Claims, 5 Drawing Figures

METHOD FOR ACOUSTICAL CLEANING

CROSS-REFERENCE TO RELATED APPLICATION

This is a continuation-in-part of application Ser. No. 521,762, now abandoned, filed by Alvin B. Kennedy, Jr. and Lawrence E. Shirey on Nov. 7, 1974.

BACKGROUND OF THE INVENTION

This invention relates to sediment cleaning and anti-sedimentation methods and devices and consists particularly in novel, more efficient means for ultrasonically cleaning objects immersed in a fluid, including tube bundles in heat exchangers.

There are many methods and apparatus for acoustically cleaning objects immersed in a fluid. Ultrasonic energy is propagated toward the object in the fluid and the acoustic energy impinges on the surface of the object where such energy loosens sedimentation and suface material to clean the object surface. However, in cleaning an object having many irregular surfaces, acoustic energy quite often fails to clean the surface because the acoustic wave trains arrive at regular, spaced intervals and often miss certain surface areas of the object.

The operation of various pipes and tubes and vessels including heat exchangers is routinely impeded by the buildup of sedimentation in and around internal surfaces and components causing restriction of flow and impediment of enthalpy or both. Devices using acoustic-type energy to resist or remove sedimentation have been suggested. In such devices, a portion of energy is imparted to tubes and other walls encountered and to molecules and particles in suspension or solution in the fluid. If the imparted energy density is less than the deposition energy of suspended or dissolved particles and/or the binding energy of deposited particles, deposition restrain and/or dislodgement of sediment particles will be less efficient in accordance with the laws of statistics. If the imparted energy density exceeds such sedimentation rate and/or binding energy, sedimentation will be prevented and existing sediment more rapidly dissipated.

However, the efficiency of prior art acoustic devices is limited, and, moreover, there is a limit to the power which can be applied to the transducer because of the so-called cavitation effect in the fluid. While composite wave devices have been suggested, these utilize resonance effect and produce resultant standing wave patterns so that the application of augmented wave intensity is limited.

SUMMARY OF THE INVENTION

An object of the present invention is to provide means for improving the efficiency of acoustic energy cleaning of objects immersed in fluid, as the walls of heat exchangers and other vessels and impede the deposition of sediment thereupon.

A more specific object is to increase the wave intensity produced by an acoustic energy cleaning device to the above type without the application of excessive power.

In accordance with the invention, a pair of transducers are mounted, preferably in opposition, in or on the vessel jacket in position to propagate through the contained fluid opposing acoustic wave trains and continuously varying at least one of the parameters, frequency and phase relationship, of at least one of said opposing wave trains for causing constructive interference between said opposing acoustic wave trains to create a series of augmented acoustic waves that are spatially displaced in relation to each other and successive in time interval for sweeping over the surfaces to be cleaned.

BRIEF DESCRIPTION OF THE DRAWINGS

In the accompanying drawings.

DESCRIPTION OF THE PREFERRED EMBODIMENT

Figure 1:
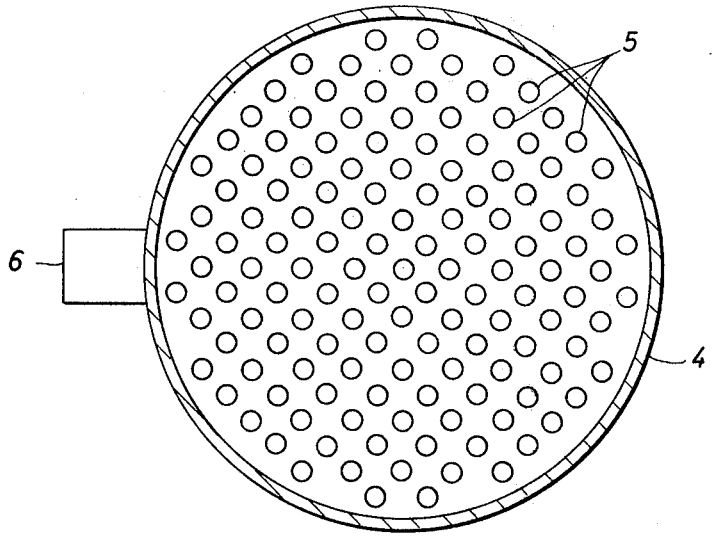
FIG. 1 PRIOR ART
FIG. 1 is a schematic cross section of a typical heat exchanger.

FIG. 1 shows in section a heat exchanger consisting of a horizontal cylindrical jacket 4 through which extends, in well-known fashion, the tube bundle 5. A transducer 6 is mounted on wall 4 for propagating acoustic vibrations through the fluid within jacket 4 and against the tubes and other fluid contacting surfaces.

Figure 2:
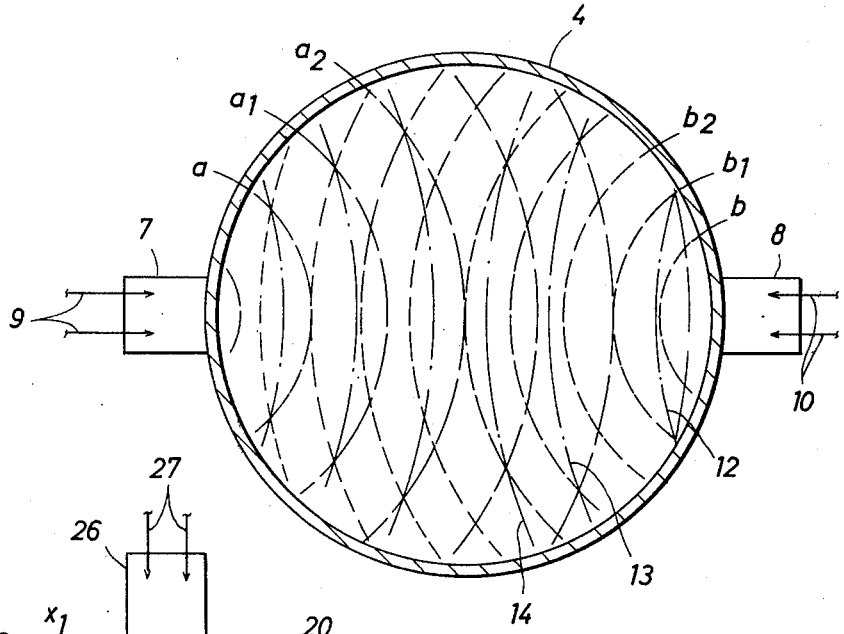
FIG. 2 is a similar view showing a pair of opposing transducers of the present invention applied to the external wall of the heat exchanger and resultant wave train fronts.

FIG. 2 represents the same cylindrical jacket 4 with the tube bundle omitted for clarity. Mounted in diametrically opposed positions on jacket 4 are a pair of transducers 7 and 8 with powering wires 9 and 10. If desired, multiple transducer units may be provided at each side. Schematically represented by curved dot-dash lines $a$, $a_1$, $a_2$, etc., and $b$, $b_1$, and $b_2$ are the normal wave crest fronts, typically spherical, emanating, respectively, from the transducers 7 and 8. The curves are spaced apart at uniform time intervals.

Wave fronts $a$, $a_1$, $a_2$, etc., are shown spaced somewhat farther apart than wave fronts $b$, $b_1$, $b_2$, symbolizing the greater wave length and lower frequency of the wave train emanating from transducer 7, and vice versa. The respective wave trains are in opposition, and their waves will constructively and destructively interfere with each other to form an augmented or reduced acoustic wave. If these wave trains were of the same frequency and intensity and of a selected phase relationship, standing waves would be produced in an undesirable manner. However, by continuously varying one of the parameters, frequency and phase relationship of at least one of transducers 7 and 8, the opposing wave trains will cause constructive interference between the opposing acoustic wave trains to create a series of augmented acoustic waves 12, 13 and 14 that are spatially displaced in relation to each other and successive in time interval for sweeping over the surfaces of the tube bundle 5 (not shown) for cleaning the surfaces and restricting sedimentation.

Figure 4:
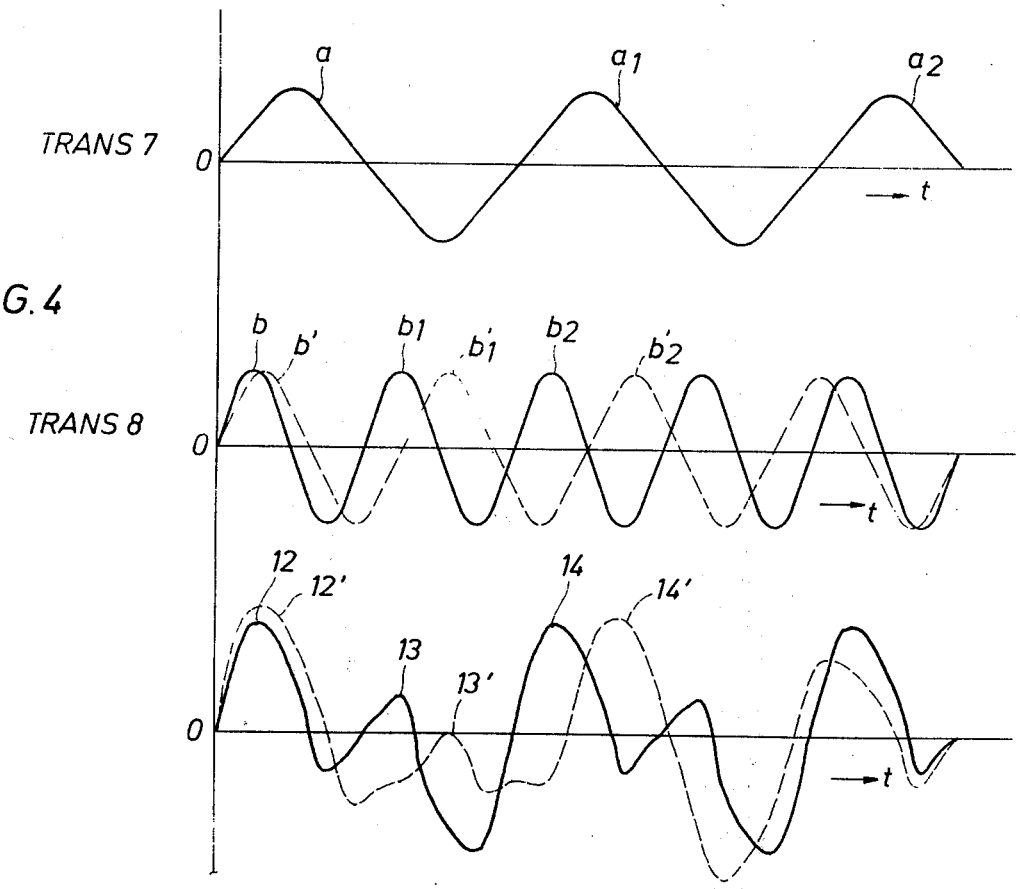
FIG. 4 is a graphical representation of wave trains propagated by the transducers shown in FIG. 2 and the opposed resultant augmented acoustic wave forms due to changes in acoustic frequency of one of the transducers.
Figure 5:
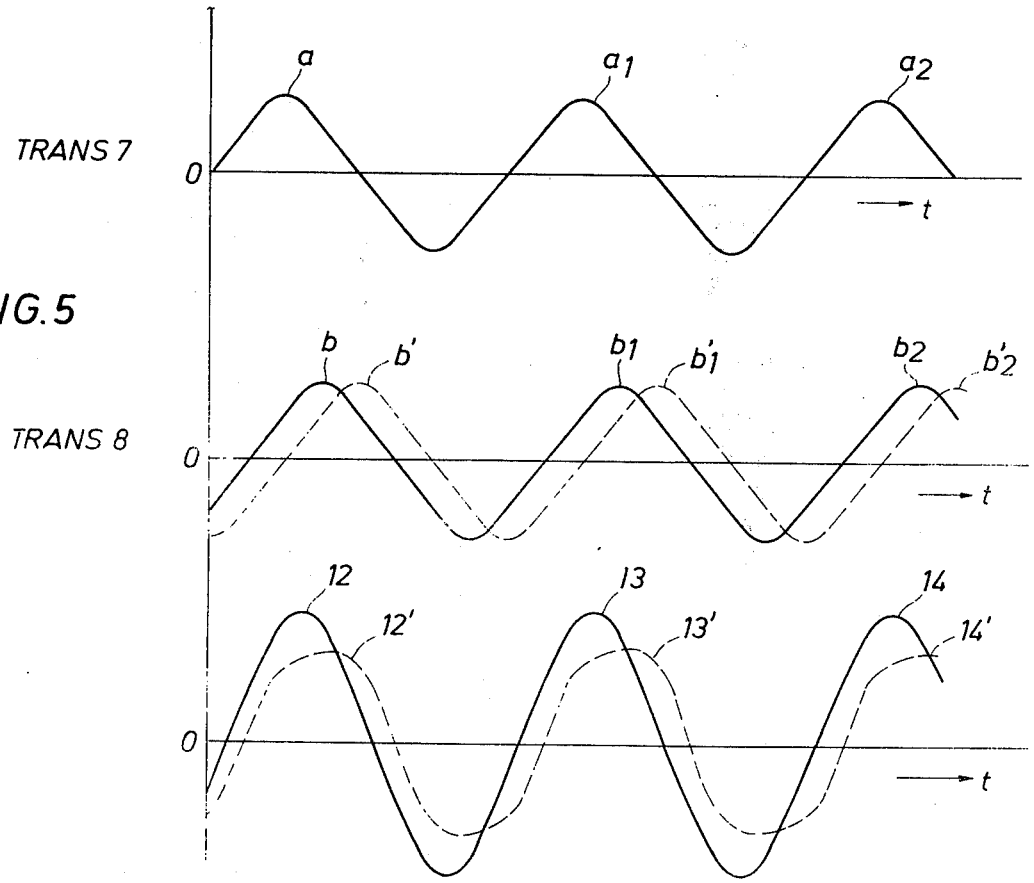
FIG. 5 is a graphical representation of wave trains propagated by the transducers shown in FIG. 2 and the opposed resultant augmented acoustic wave forms due to changes in the phase relationship of the acoustic waves produced by one of the transducers.
Figure 1:
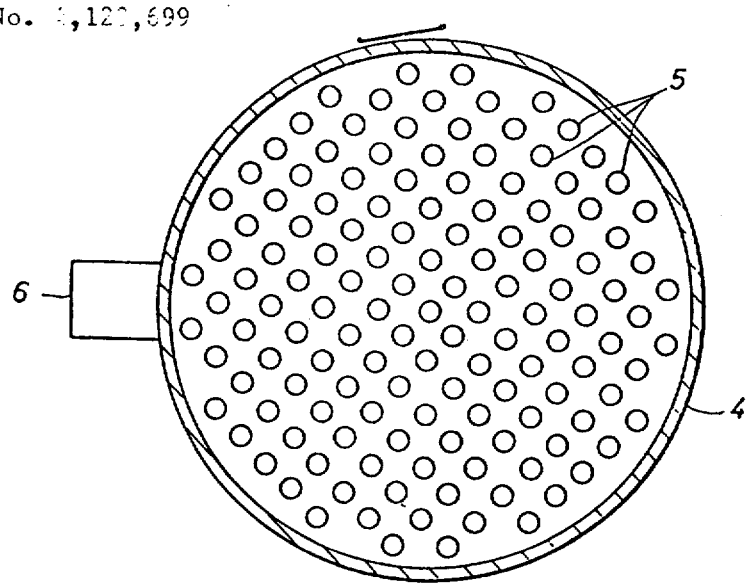
FIG. 1 PRIOR ART
Figure 2:
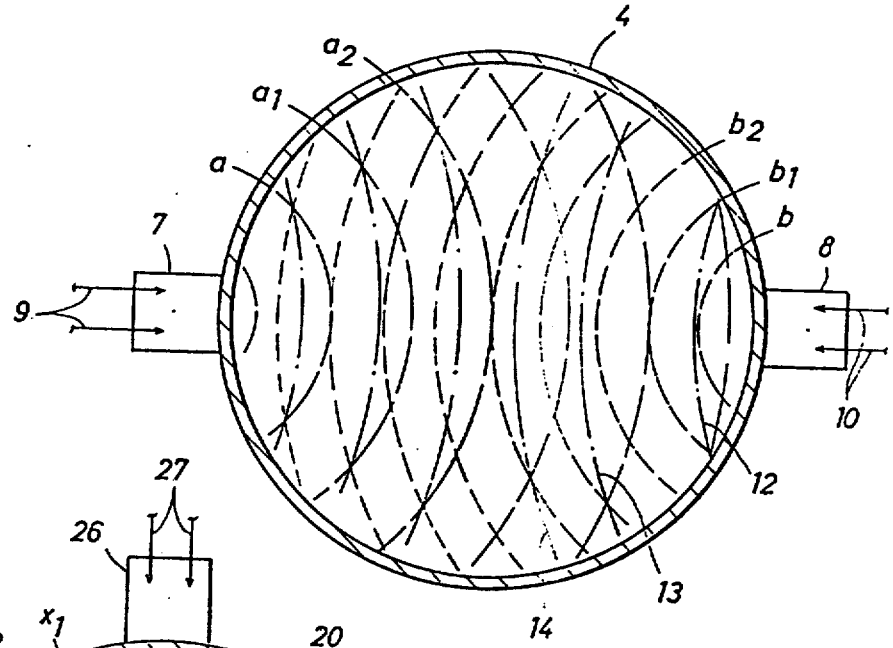
Figure 3:
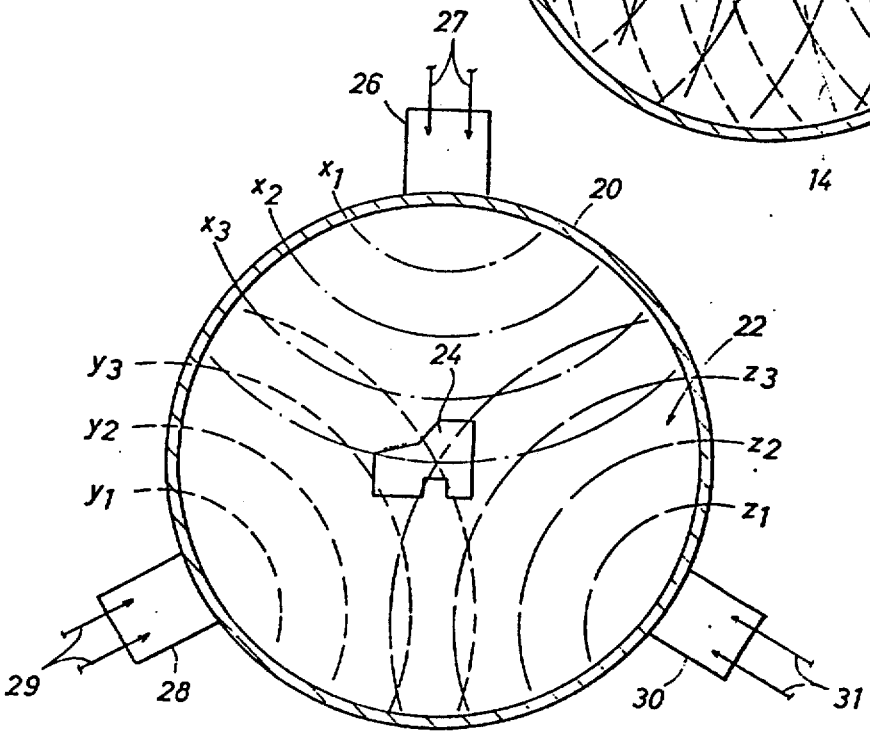
Figure 4:
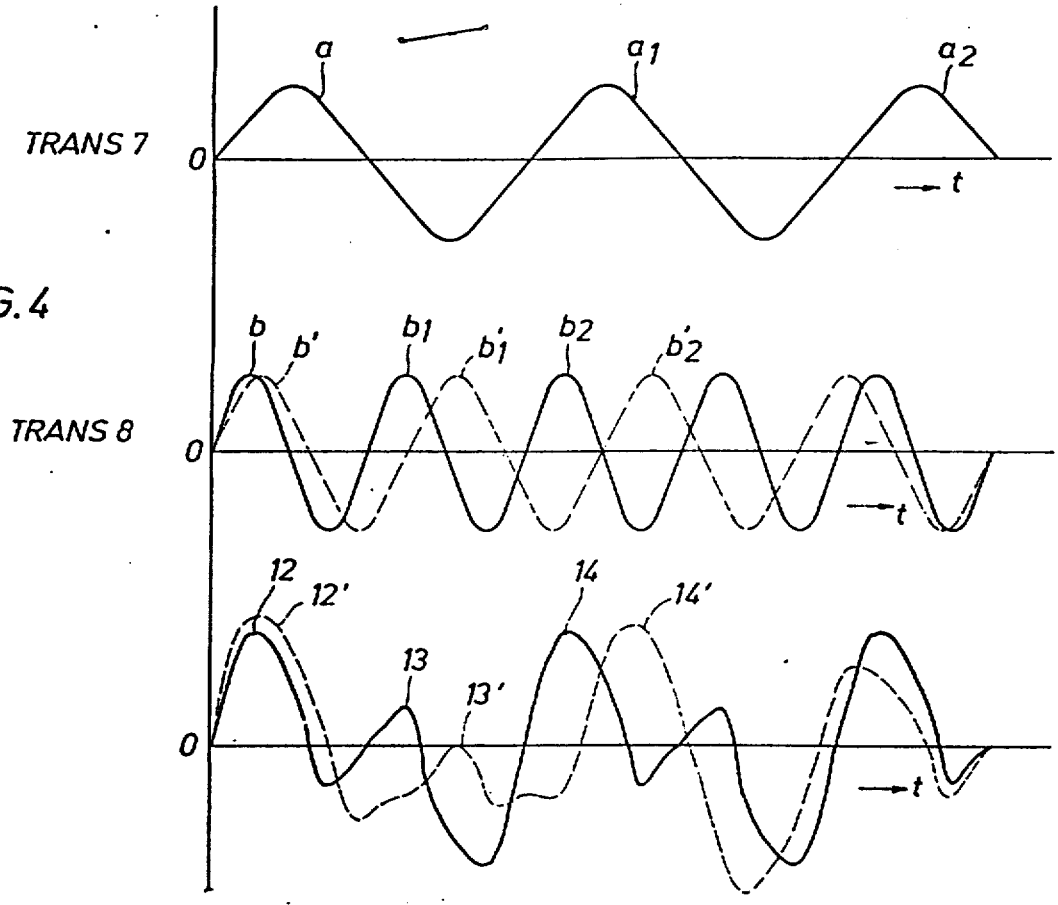
Figure 5:
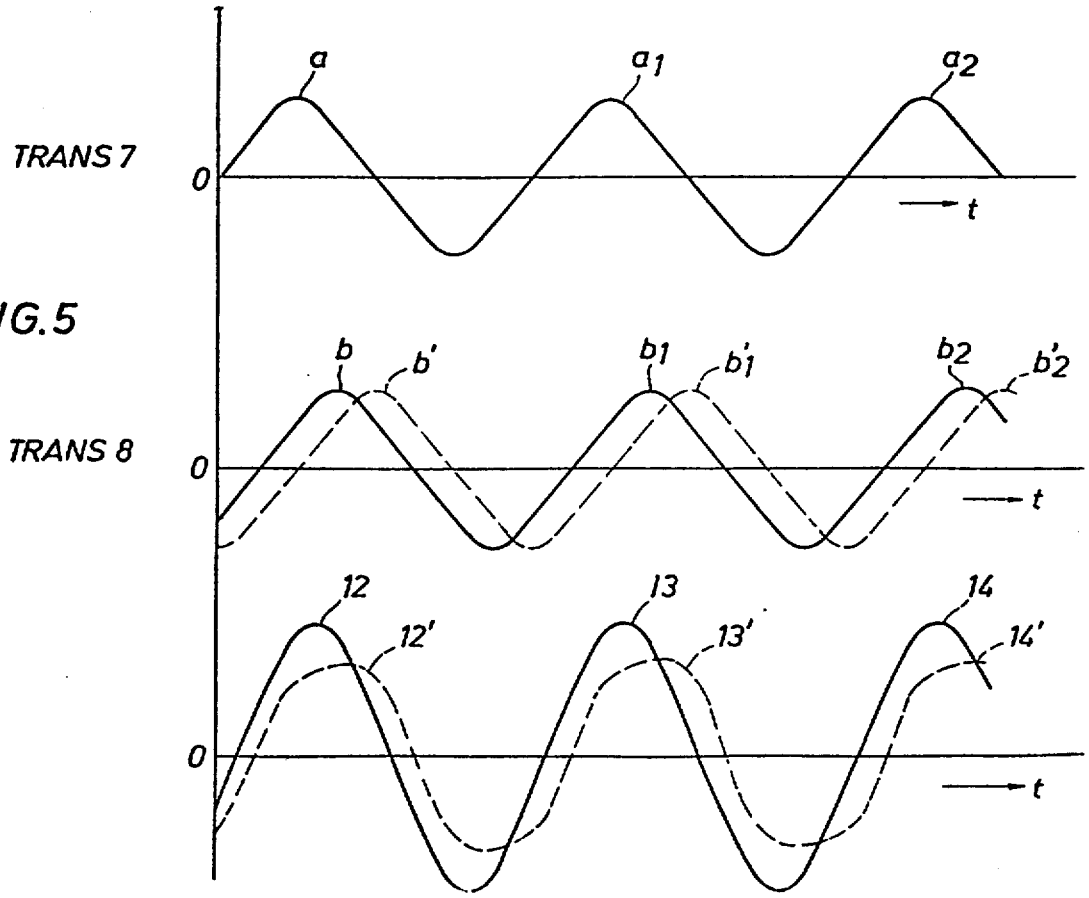

The operation of such augmented acoustic waves can be more readily appreciated by reference to FIGS. 4 and 5. In FIG. 4, the acoustic wave train propagating from transducers 7 and 8 are shown. The positive wave crests $a$, $a_1$, $a_2$, etc. are shown radiating from transducer 7. The acoustic wave crests $b$, $b_1$, $b_2$, etc. are shown radiating from transducer 8. The wave trains generated by transducer 8 are one-half the frequency of the acoustic wave signals generated by transducer 7, but in phase with the signals. The result of constructive and destructive interference between waves $a$, $a_1$, $a_2$, etc. and $b$, $b_1$, $b_2$, etc. is shown in the third graph having augmented wave crests or peaks 12, 13 and 14. If the frequency of the signals from transducer 8 is changed as shown by the dotted line having peaks $b^1$, $b_1^1$, $b_2^1$, etc., then the resulting interference pattern of the opposing wave trains is shown by the dotted lines having peaks 12$^1$, 13$^1$, 14$^1$, etc.

As may be seen, varying the frequency of one of the opposing wave trains can cause constructive interference between the opposing acoustic waves for forming a series of augmented acoustic waves that are spatially displaced in relation to each other and successive in time interval for sweeping the waves 12–12$^1$, 13–13$^1$, 14–14$^1$, etc. over the surfaces of the tube bundle or of a body to be cleaned.

Similarly, referring to FIG. 5, the acoustic wave train propagating from transducers 7 and 8 are shown, but the phase relationship between the wave trains is different although the frequency remains the same. The positive wave crests $a$, $a_1$, $a_2$, etc. are shown radiating from transducer 7. Acoustic waves propagating from transducer 8 are shown having wave crests $b$, $b_1$, $b_2$, etc. The two wave signals are of the same frequency but are shifted 45° with respect to each other, resulting in the augmented wave represented by 12, 13, 14, etc. If the wave signals from transducer 8 are shifted from 45° to 90° relationship, the resulting wave form will be as represented by $b^1$, $b_l^l$, $b_2^1$, etc. and the interferring wave pattern will be represented by 12$^1$, 13$^1$, 14$^1$, etc. Shifting the phase relationship between the opposing acoustic wave trains will cause constructive interference between the opposing acoustic waves for forming a series of augmented acoustic waves that are spatially displaced in relation to each other and successive in time interval for sweeping over the surfaces of the tube bundle or of a body to be cleaned.

The spatial progression and successive time interval of the augmented waves will cause a continuous sweeping action over the surface to be cleaned and excite the activity of sedimentation particles in order to resist sedimentation. The variation in intensity and frequency of the resulting augmented waves will cause a cleaning action even in irregular surfaces.

The acoustic wave signal frequency can be any suitable acoustic wave frequency, however, frequencies in the supersonic and ultra-sonic frequency range are generally found to be most suitable. In FIG. 2, only a pair of transducers are shown, however, any number may be employed, suitably spaced, to propagate a plurality of opposing acoustic wave trains through the vessel fluid. Utilizing the constructive interference phenomana permits energy densities in the augmented wave fronts that are higher than the cavitation energy level, which is the limiting maximum intensity at the transducer interface coupling. A plurality of acoustic wave trains, the intensity of each being below the cavitation level, can, in opposition, constructively interfere to form an augmented wave front, having a much higher intensity than any one of the individual acoustic wave trains.

Figure 3:
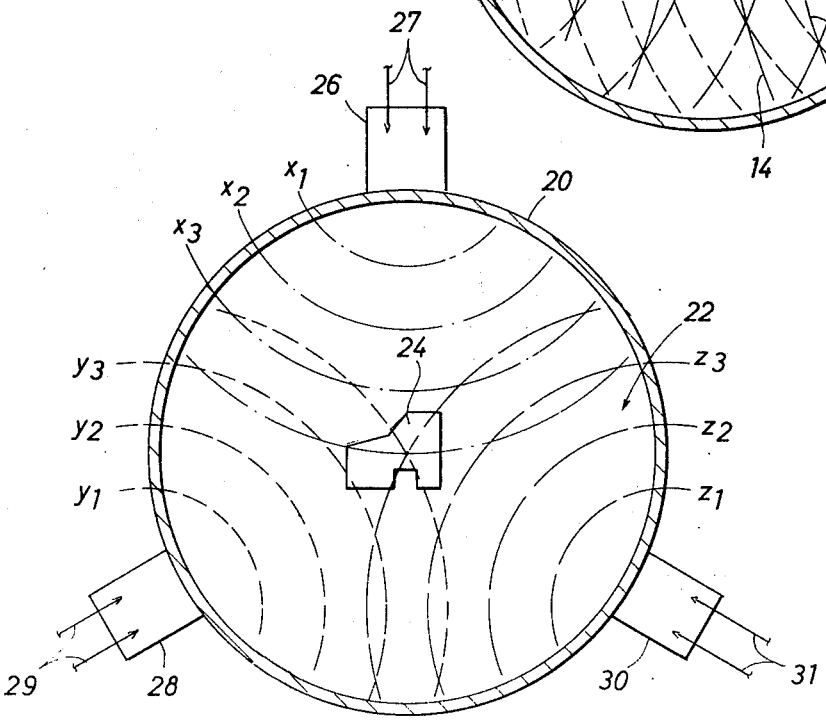
FIG. 3 is a horizontal cross section of a cylindrical tank filled with fluid and in which an irregular surfaced body is immersed for acoustic cleaning.

Referring now to FIG. 3, another embodiment of the cleaning apparatus is shown. A cylindrical tank 20 has therein a fluid 22 and immersed centrally in the fluid is a body 24 having irregular surfaces to be cleaned. Three transducers, 26, 28 and 30, having electrical input leads 27, 29 and 31, respectively, are shown equally spaced about the walls of tank 20. Transducer 26 produces an acoustic wave train depicted by X, $X_1$, $X_2$, etc., transducer 28 produces an acoustic wave train depicted by Y, $Y_1$, $Y_2$, etc., while transducer 30 produces an acoustic wave train depicted by Z, $Z_1$, $Z_2$, etc.

Utilizing the theory above described, the wave trains X, $X_1$, $X_2$, etc., Y, $Y_1$, $Y_2$, etc. and z, $z_l$, $z_2$, etc. can be chosen to have an appropriate continuously varying frequency or phase relationship for causing constructive interference between said opposing acoustic wave trains to create a series of augmented acoustic waves that are spatially displaced in relation to each other and successive in time interval for sweeping over the surfaces of the body 24 to be cleaned. In this manner, hard to clean objects, having many irregular surfaces, such as an automobile engine block or the like could be cleaned in a short period of time. Best results can be obtained if the difference in frequencies of the opposing wave trains are very small. Of course, the invention may be applied to various types of vessels containing an acoustically conducting fluid for cleaning objects immersed therein, or the inner walls of the vessel, and the word "vessel," as used herein and in the claims, is intended to encompass all applications.

Numerous variations and modifications may obviously be made in the structure herein described without departing from the present invention. Accordingly, it should be clearly understood that the forms of the invention herein described and shown in the figures of the accompanying drawings are illustrative only and are not intended to limit the scope of the invention.

What is claimed is:

1. The method of cleaning the surfaces of a body immersed in a liquid contained in a vessel, comprising the steps of propagating a plurality of opposing acoustic wave trains through the liquid in said vessel, wherein each wave train includes a series of wave fronts having a frequency and phase relationship, and limiting the energy level in each wave train to below the cavitation level of the liquid, and continuously varying the frequency of at least one of said wave trains with respect to the other wave trains for causing constructive interference between said opposing acoustic wave trains to create a series of augmented acoustic waves that are spatially displaced in relation to each other and successive in time interval, each augmented wave having an intensity greater than the cavitation level of the liquid for cleaning the surfaces of the body by sweeping over the surfaces.

2. The method of cleaning the surfaces of a body immersed in a liquid contained in a vessel, comprising the steps of propagating a plurality of opposing acoustic wave trains through the liquid in said vessel, wherein each wave train includes a series of wave fronts having a frequency and phase relationship, and limiting the energy level in each wave train to below the cavitation level of the liquid, and continuously varying the phase relationship of at least one of said wave trains with respect to the other wave trains for causing constructive interference between said opposing acoustic wave trains to create a series of augmented acoustic waves that are spatially displaced in relation to each other and successive in time interval, each augmented wave having an intensity greater than the cavitation level of the liquid for cleaning the surfaces of the body by sweeping over the surfaces.

3. The method of cleaning the surfaces of a body immersed in a liquid contained in a vessel, comprising the steps of propagating a plurality of opposing acoustic wave trains through the liquid in said vessel, wherein each wave train includes a series of wave fronts having a frequency and phase relationship, limiting the energy level in each wave train to below the cavitation level of the liquid, and continuously varying at least one of the frequency and phase relationships of at least one of said opposing wave trains with respect to the other wave trains for causing constructive interference between said opposing acoustic wave trains to create a series of augmented acoustic waves that are spatially displaced in relation to each other and successive in time interval, each augmented wave having an intensity greater than the cavitation level of the liquid for cleaning the surfaces of the body by sweeping over the surfaces.

4. The method as described in claim 3, wherein the frequency of said acoustic wave trains are in the ultrasonic range.

5. The method as described in claim 3, wherein said acoustic wave trains travel in substantially direct opposition to each other.

6. The method of cleaning the surfaces of a body immersed in a liquid contained in a vessel, comprising the steps of propagating a plurality of opposing acoustic wave trains through the liquid in said vessel, wherein each wave train includes a series of wave fronts having a frequency and phase relationship, and limiting the energy level in each wave train to below the cavitation level of the liquid, was continuously varying the frequency and phase relationship one of said wave trains with respect to the other wave trains for causing constructive interference between said opposing acoustic wave trains to create a series of augmented acoustic waves that are spatially displaced in relation to each other and successive in time interval, each augmented wave having an intensity greater than the cavitation level of the liquid for cleaning sediment from and impeding the deposition of sediment on the walls.

7. The method as described in claim 6, wherein the frequency of said acoustic wave trains are in the ultrasonic range.

8. The method as described in claim 6, wherein said acoustic wave trains travel in substantially direct opposition to each other.

9. A method of cleaning sediment from and impeding the deposition of sediment on the surfaces of the walls of a heat exchanger jacket containing a liquid and the surfaces of a bundle of tubes supported within the jacket, comprising:

propagating a plurality of opposing acoustic wave trains through the liquid in the jacket, wherein each wave train includes a series of wave fronts having a frequency and phase relationship, limiting the energy level in each wave train to below the cavitation level of the liquid, and continuously varying the frequency and phase relationship of one of the acoustic wave trains with respect to the other wave trains for causing constructive interference between the opposing acoustic wave trains to create a series of augmented acoustic waves that have an intensity greater than the cavitation level of the liquid for cleaning the sediment from and impeding the deposition of sediment on the surfaces.

10. The method as described in claim 9, wherein the frequency of said acoustic wave trains are in the ultrasonic range.

11. The method as described in claim 9, wherein said acoustic wave trains travel in substantially direct opposition to each other.

* * * * *

UNITED STATES PATENT AND TRADEMARK OFFICE

CERTIFICATE OF CORRECTION

PATENT NO. : 4,120,699

DATED : October 17, 1978

INVENTOR(S) : Alvin B. Kennedy, Jr.; Lawrence E. Shirey; Harper Eugene Sharp; Larence E. Trowbridge; Robert L. Magee It is certified that error appears in the above-identified patent and that said Letters Patent are hereby corrected as shown below:

The drawings shown with the Patent No. 4,120,699 are incorrect. Please submit the attached drawings to the patent.

Signed and Sealed this

Sixth Day of March 1979

[SEAL]

*Attest:*

RUTH C. MASON
*Attesting Officer*

DONALD W. BANNER
*Commissioner of Patents and Trademarks*